US011165176B2

(12) United States Patent
Seo et al.

(10) Patent No.: US 11,165,176 B2
(45) Date of Patent: Nov. 2, 2021

(54) BLOCK TERMINAL FOR MOTOR AND METHOD OF MANUFACTURING SAME

(71) Applicant: HYUNDAI MOBIS Co., Ltd., Seoul (KR)

(72) Inventors: Yeong Woo Seo, Busan (KR); Jung Kyu Yim, Suwon-si (KR)

(73) Assignee: Hyundai Mobis Co., Ltd., Seoul (KR)

( * ) Notice: Subject to any disclaimer, the term of this patent is extended or adjusted under 35 U.S.C. 154(b) by 0 days.

(21) Appl. No.: 16/576,109

(22) Filed: Sep. 19, 2019

(65) Prior Publication Data

US 2020/0106198 A1 Apr. 2, 2020

(30) Foreign Application Priority Data

Sep. 27, 2018 (KR) ..... 10-2018-0115039

(51) Int. Cl.
*H01R 9/24* (2006.01)
*H01R 43/24* (2006.01)
*H01R 9/22* (2006.01)

(52) U.S. Cl.
CPC ..... *H01R 9/24* (2013.01); *H01R 9/223* (2013.01); *H01R 43/24* (2013.01); *H01R 2201/26* (2013.01)

(58) Field of Classification Search
CPC ..... H01R 9/24; H01R 9/223; H01R 43/24; H01R 2201/26; H01R 9/00; H01R 2105/00; H01R 4/30; H01R 11/26; H02K 5/225
USPC ..... 439/709, 723, 733.1, 737
See application file for complete search history.

(56) References Cited

U.S. PATENT DOCUMENTS 6,361,382 B1 * 3/2002 Yamada ..... H01R 4/302 439/801
8,251,756 B2 * 8/2012 Matsuoka ..... H01R 9/18 439/737
8,366,492 B2 * 2/2013 Erickson ..... H01R 9/24 439/709
8,545,265 B2 * 10/2013 Sakamoto ..... B29C 45/14467 439/606
8,608,515 B2 * 12/2013 Tate ..... B29C 45/14467 439/686
8,790,135 B2 * 7/2014 Maegawa ..... H01R 13/521 439/587
9,287,649 B2 * 3/2016 Okayasu ..... H01R 13/424
2019/0006775 A1 * 1/2019 Kan ..... H01R 12/515

FOREIGN PATENT DOCUMENTS

KR 10-2004-0100705 12/2004

* cited by examiner

*Primary Examiner* — Travis S Chambers
(74) *Attorney, Agent, or Firm* — H.C. Park & Associates, PLC

(57) ABSTRACT

A block terminal for a motor includes a block base, a busbar, bushings, and fixing nuts. The busbar is disposed in the block base and includes end portions protruding outward from the block base. The end portions include coupling holes. The bushings are mounted on sides of the block base. The fixing nuts are insert-mounted in the coupling holes of the busbar.

19 Claims, 7 Drawing Sheets

BLOCK TERMINAL FOR MOTOR AND METHOD OF MANUFACTURING SAME

CROSS-REFERENCE TO RELATED APPLICATION

This application claims priority to and the benefit of Korean Patent Application No. 10-2018-0115039, filed Sep. 27, 2018, which is hereby incorporated by reference for all purposes as if set forth herein.

BACKGROUND

Field

Exemplary embodiments generally relate to a block terminal for a motor and a method of manufacturing the same, and, more specifically, to a block terminal for a motor, which is manufactured through insert injection molding to improve vibration resistance performance and in which the number of components and the number of assembly processes decrease, and a method of manufacturing the same.

Discussion

Generally, block terminals serve to mechanically connect high voltage connectors and terminal assemblies and serve as bridges over which current flows.

In a recently developed block terminal of a driving motor of a hybrid electric vehicle (HEV), a busbar configured to flow a current is epoxy painted for insulation, assembled with a block base, and fixed by a block cover.

There was a problem in that a shape of the block base should be complex to position a nut for connecting the high voltage connector and a terminal assembly.

Accordingly, there were problems in that, since the number of insulation coatings and the number of components of the busbar are large, the number of assembly processes increases, when a shape of the busbar is changed according to a vehicle model, a degree of design freedom is limited due to the complex shape and the assembly components, and since the number of molds is large, material and investment costs are inevitably increased, and thus cost competitiveness is low.

In addition, since the busbar has a bent structure, and angles of items are minutely different from each other, there are problems in that a new busbar design is required and the busbar cannot be shared.

The above information disclosed in this section is only for understanding the background of the inventive concepts, and, therefore, may contain information that does not form prior art.

SUMMARY

Exemplary embodiments are directed to providing a block terminal for a motor which is manufactured through insert injection molding and capable of improving vibration resistance performance and in which the number of components and the number of assembly processes decrease, and a method of manufacturing the same.

In addition, exemplary embodiments are directed to providing a block terminal for a motor which has a straight busbar structure to decrease a volume, and a method of manufacturing the same.

In addition, exemplary embodiments are directed to providing a block terminal for a motor in which the number of components is decreased and convenience is also improved, and a method of manufacturing the same.

Additional aspects will be set forth in the detailed description which follows, and, in part, will be apparent from the disclosure, or may be learned by practice of the inventive concepts.

According to some exemplary embodiments, a block terminal for a motor includes a block base, a busbar, bushings, and fixing nuts. The busbar is disposed in the block base and includes end portions protruding outward from the block base. The end portions include coupling holes. The bushings are mounted on sides of the block base. The fixing nuts are insert-mounted in the coupling holes of the busbar.

In some exemplary embodiments, the block base and the busbar may extend in a vertical direction.

In some exemplary embodiments, the block base and the busbar may include bent portions.

In some exemplary embodiments, a strength reinforcement piece may be formed on a bent portion of the block base among the bent portions.

In some exemplary embodiments, the busbar may be one of a plurality of busbars disposed in the block base, and the plurality of busbars may be spaced apart from one another in the block base.

In some exemplary embodiments, the block base, the busbar, and the bushings may be integrally formed through insert injection molding.

In some exemplary embodiments, a rear surface of the block base may include insertion coupling grooves spaced apart from one another.

In some exemplary embodiments, a base coupling protrusion may protrude outwardly from a rear surface of the block base.

In some exemplary embodiments, the bushings may longitudinally extend in a first direction, a first some of the coupling holes may longitudinally extend in a second direction, and a second some of the coupling holes may longitudinally extend in a third direction.

In some exemplary embodiments, the first and second directions may be substantially parallel with one another.

In some exemplary embodiments, the first and third directions may be different from one another.

In some exemplary embodiments, the first and third directions may be substantially perpendicular to one another.

In some exemplary embodiments, the first and second directions may be different from one another.

In some exemplary embodiments, the second and third directions may be substantially parallel with one another.

In some exemplary embodiments, the first and second directions may be substantially perpendicular to one another.

In some exemplary embodiments, the sides of the block base may oppose one another with a portion of the busbar disposed therebetween.

In some exemplary embodiments, the sides of the block base may protrude from an end surface of the block base from which an end portion of the busbar protrudes among the end portions of the busbar.

In some exemplary embodiments, the sides of the block base may protrude from a central region of the block base.

According to some exemplary embodiments, a method of manufacturing a block terminal for a motor includes: forming, via insert injection molding, a block base including a busbar and bushings, the busbar including bent portions and the bushings being disposed on sides of the block base; and forming a block terminal by press-fitting a coupling nut into a coupling hole formed in an end portion of the busbar.

In some exemplary embodiments, the busbar may be one of a plurality of busbars disposed in the block base, and the plurality of busbars may be spaced apart from one another in the block base.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts. In the drawings.

DETAILED DESCRIPTION OF THE ILLUSTRATED EMBODIMENTS

Figure 1:
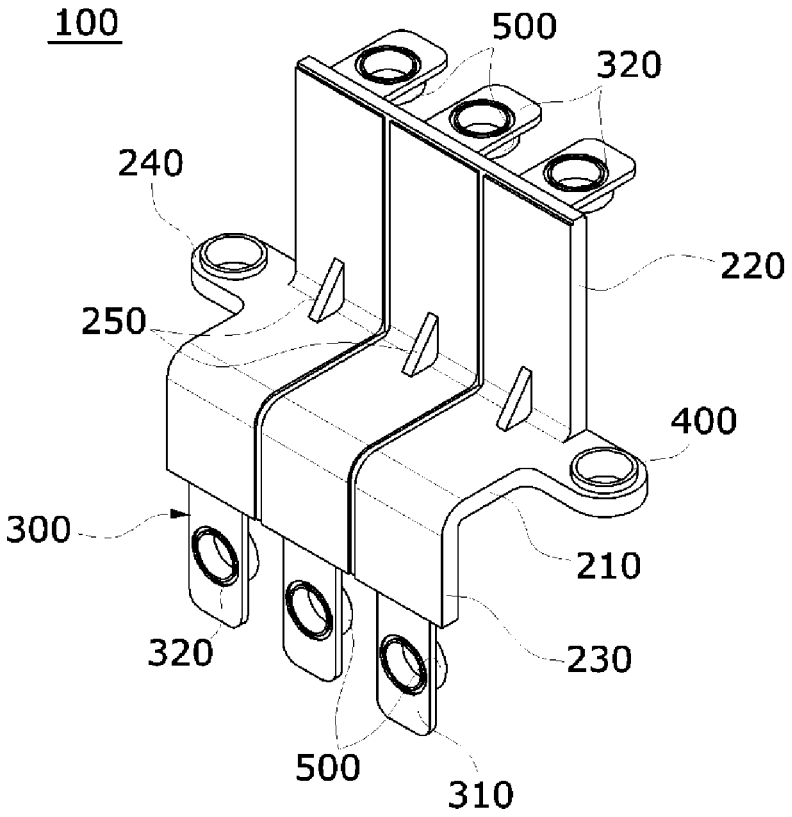
FIG. 1 is a perspective view illustrating a block terminal for a motor according to some exemplary embodiments.

In the following description, for the purposes of explanation, numerous specific details are set forth in order to provide a thorough understanding of various exemplary embodiments. As used herein, the terms "embodiments" and "implementations" are used interchangeably and are non-limiting examples employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some exemplary embodiments. Therefore, unless otherwise specified, the features, components, modules, layers, films, panels, regions, aspects, etc. (hereinafter individually or collectively referred to as an "element" or "elements"), of the various illustrations may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. As such, the sizes and relative sizes of the respective elements are not necessarily limited to the sizes and relative sizes shown in the drawings. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. Other terms and/or phrases used to describe a relationship between elements should be interpreted in a like fashion, e.g., "between" versus "directly between," "adjacent" versus "directly adjacent," "on" versus "directly on," etc. Further, the term "connected" may refer to physical, electrical, and/or fluid connection. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one element's relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various exemplary embodiments are described herein with reference to sectional views, isometric views, perspective views, plan views, and/or exploded illustrations that are schematic illustrations of idealized exemplary embodiments and/or intermediate structures. As such, variations from the shapes of the illustrations as a result of, for example, manufacturing techniques and/or tolerances, are to be expected. Thus, exemplary embodiments disclosed herein should not be construed as limited to the particular illustrated shapes of regions, but are to include deviations in shapes that result from, for instance, manufacturing. To this end, regions illustrated in the drawings may be schematic in nature and shapes of these regions may not reflect the actual shapes of regions of a device, and, as such, are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Hereinafter, various exemplary embodiments will be explained in detail with reference to the accompanying drawings.

Figure 2:
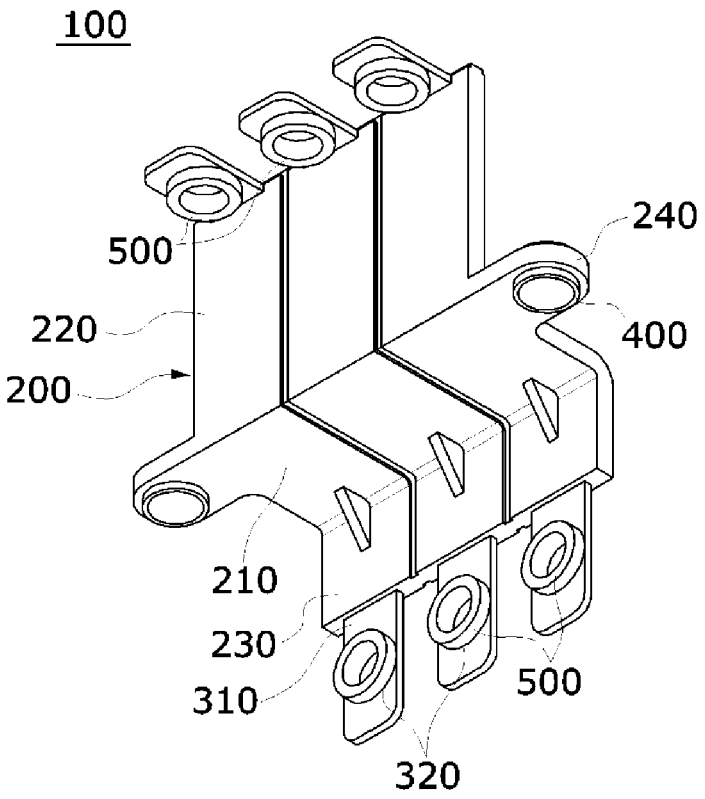
FIG. 2 is a rear perspective view illustrating the block terminal for a motor according to some exemplary embodiments.

FIG. 1 is a perspective view illustrating a block terminal for a motor according to some exemplary embodiments, and FIG. 2 is a rear perspective view illustrating the block terminal for a motor according to some exemplary embodiments.

A block terminal 100 for a motor according to some exemplary embodiments includes a block base 200, busbars 300, bushings 400, and fixing nuts 500.

The block base 200 is formed through insert injection molding.

That is, since the block base 200 is formed through insert injection molding, there are advantages in that a conventional epoxy coating and a cover are eliminated and the number of molds and the number of assembly processes decrease, and thus the amount of materials used can decrease.

In addition, the block base 200 is formed to be bent several times.

Specifically, in the block base 200, upper vertical surfaces 220 are formed in an upward direction perpendicular to one side end of a horizontal surface 210, lower vertical surfaces 230 are formed in a downward direction perpendicular to the other side end thereof, and bushing fixing portions 240 to which the bushings 400 are fixed are formed to protrude from both sides of the horizontal surface 210.

In addition, strength reinforcement pieces 250 are formed at bent portions of the block base 200.

That is, one or more strength reinforcement pieces 250 are formed at the bent portions between the horizontal surface 210 and the upper vertical surfaces 220, and between the horizontal surface 210 and the lower vertical surfaces 230 to support the horizontal surface 210 and the vertical surfaces 220 and 230 while also reinforcing strength.

Figure 3:
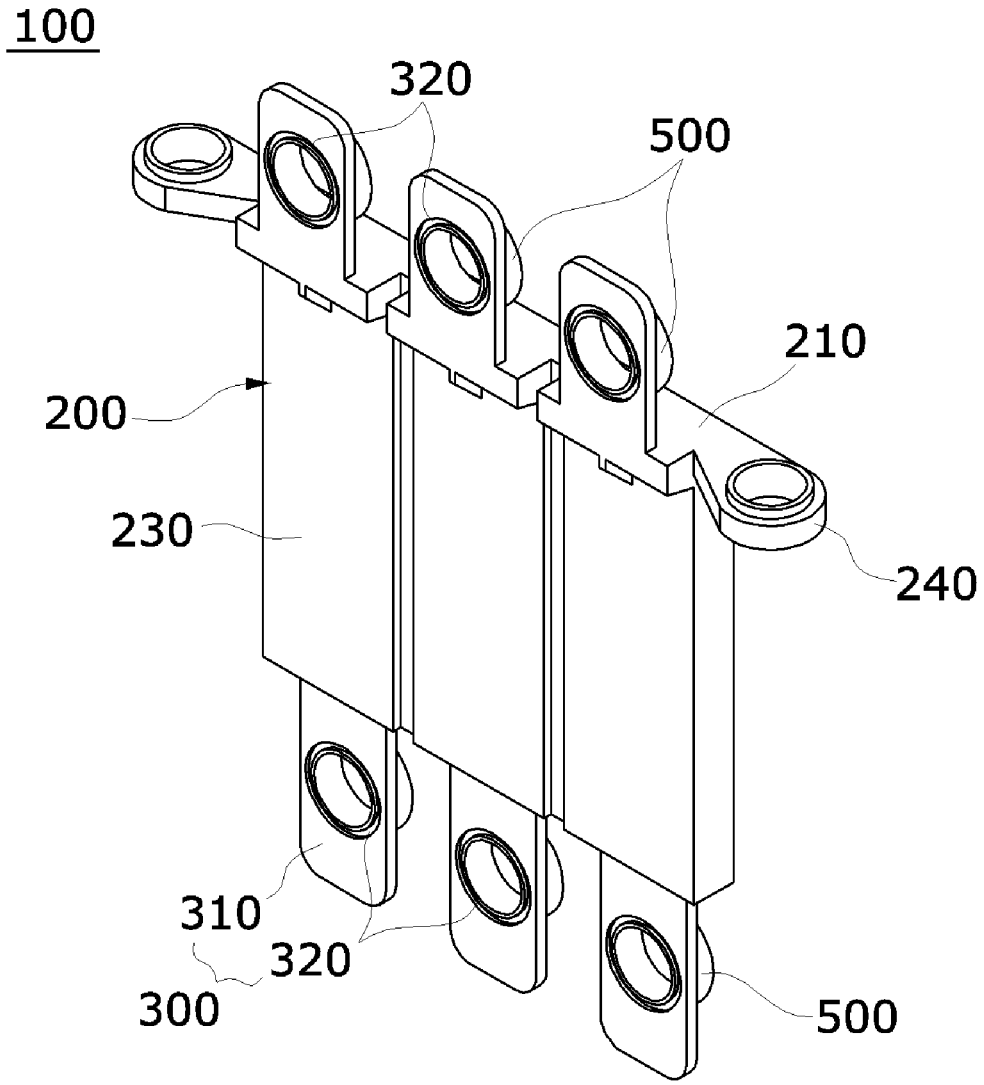
FIGS. 3 and 4 are perspective views illustrating a block terminal for a motor according to according to some exemplary embodiments.
Figure 4:
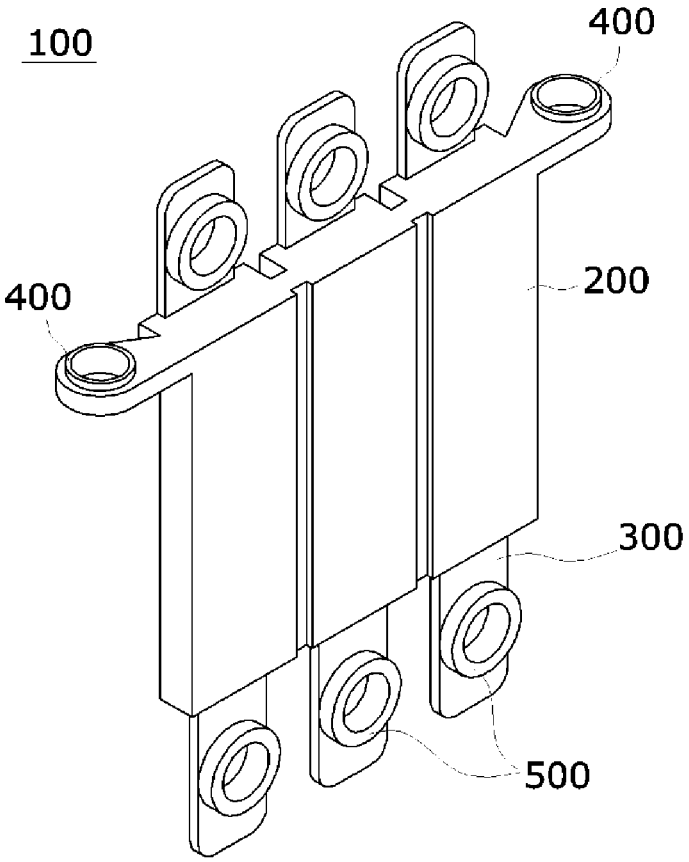

Next, a block base 200 may be formed in a vertical direction as illustrated in FIGS. 3 and 4.

That is, in the block base 200, a pair of bushing fixing portions 240 are formed on both sides of a horizontal surface 210, lower vertical surfaces 230 having a linear form are formed below the horizontal surface 210, and thus there are effects in that a volume is decreased and the block base 200 is shared.

In addition, in the block base 200, there are advantages, which are the same as those of the block base 200 illustrated in FIG. 1, in that an overall volume can be decreased, and the block base 200 can be shared with other items.

Here, strength reinforcement pieces 250 are formed on the horizontal surface 210 and the lower vertical surfaces 230 to support the horizontal surface 210 and the lower vertical surfaces 230 and to reinforce strength thereof.

Figure 5A:
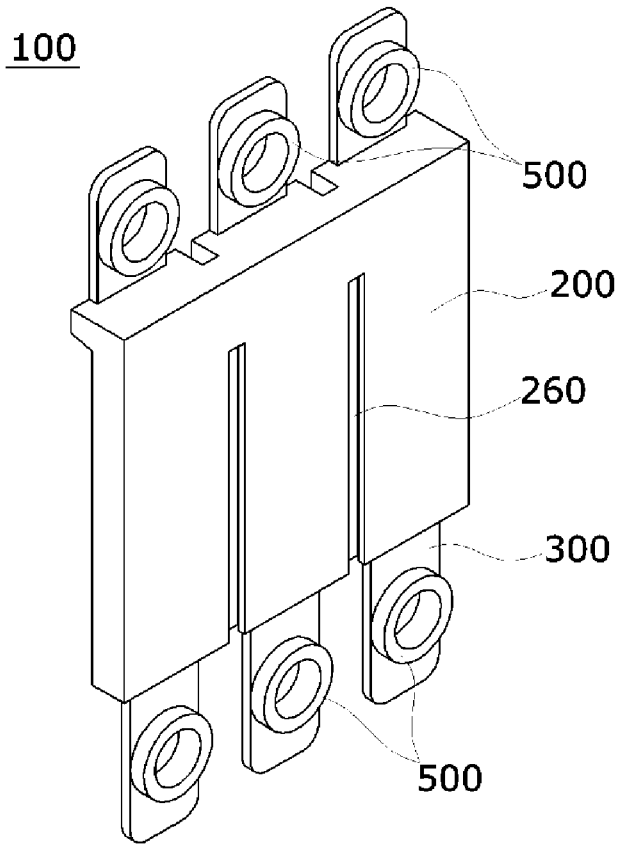
FIG. 5A and FIG. 5B show a perspective view and a bottom view illustrating a block terminal for a motor according to some exemplary embodiments.
Figure 5B:
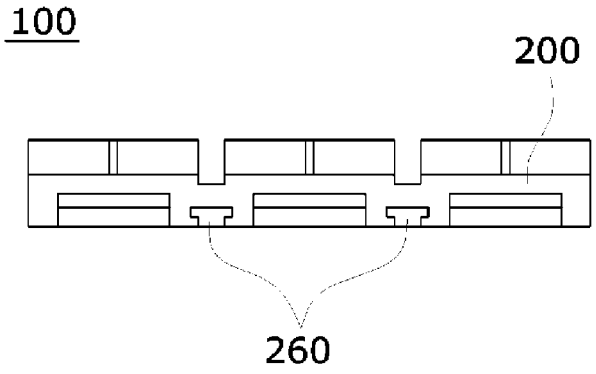

Next, insertion coupling grooves 260 may be formed in a rear surface of a block base 200 as illustrated in FIG. 5A and FIG. 5B.

That is, a bushing needed for conventional bolt coupling is eliminated from a rear surface of the block base 200 which is straightly formed as illustrated in FIGS. 3 and 4, at least one insertion coupling groove 260 is formed in a vertical direction, and the block base 200 is coupled to a coupling protrusion of a target object (not shown).

Here, the insertion coupling grooves 260 are formed between busbars 300 mounted on the block base 200.

Figure 6:
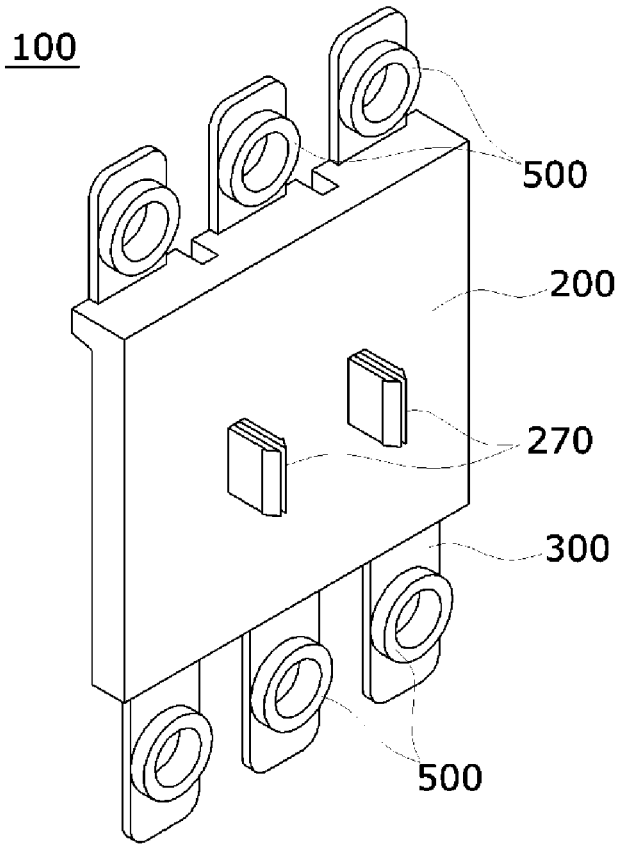
FIG. 6 is a perspective view illustrating a block terminal for a motor according to some exemplary embodiments.

In addition, coupling protrusions 270 may be formed on a rear surface of a block base 200 as illustrated in FIG. 6.

Busbars 300 are mounted on the block base 200 so as to supply and transmit power.

In addition, bodies 310 of the busbars 300 except for both ends are disposed inside the block base 200, and coupling holes 320 are formed in the both ends.

That is, when the block base 200 is injection-molded, the bodies 310 of the busbars 300 are integrally injection-molded so that the bodies 310 are disposed in and fixed to the block base 200, and fixing nuts 500 coupled to terminals are insert-mounted into the coupling holes 320 positioned outside the block base 200.

In addition, a shape of the busbar 300 is formed according to a shape of the block base 200.

That is, in the case in which the block base 200 is formed to be bent several times as illustrated in FIGS. 1 and 2, the busbar 300 is formed to be bent several times, and in the case in which the block base 200 is straightly formed as illustrated in FIGS. 3 and 4, the busbar 300 is straightly formed.

The bushings 400 are mounted on the block base 200 and fixed to a structure using coupling units.

In addition, the bushings 400 are mounted on both sides of the block base 200 on the basis of the busbars 300.

That is, the bushings 400 are disposed in and fixed to the bushing fixing portions 240 of the horizontal surface 210 when the block base 200 is injection-molded.

The fixing nuts 500 are insert-mounted into the coupling holes 320 of the busbars 300 and coupled to connecting terminals using coupling units.

That is, the fixing nuts 500 are insert-mounted into the coupling holes 320 of the busbars 300 fixed to the block base 200, and fix terminals coupled to ends of the block base 200 using coupling units such as bolts and nuts.

A method of manufacturing a block terminal for a motor will be described below.

First, a plurality of busbars 300 in which coupling holes 320 are formed in both ends of bodies 310 formed to be bent several times and bushings 400 having a predetermined thickness and a hollow shape are provided.

Next, the busbars 300 are disposed to be spaced a distance from each other, the bushings 400 are disposed on both sides of the busbars 300, and a block base 200 including the plurality of busbars 300 and two bushings 400 are formed through insert injection molding.

Here, in the block base 200, upper vertical surfaces 220 are formed in an upward direction perpendicular to one side end of a horizontal surface 210, lower vertical surfaces 230 are formed in a downward direction perpendicular to the other side end thereof, and bushing fixing portions 240 to which the bushings 400 are fixed are formed to protrude from both sides of the horizontal surface 210.

Then, when fixing nuts 500 are inserted into coupling holes 320 of the busbars 300 coupled to the block base 200, assembly of a block terminal 100 for a motor is completed.

Here, an assembly sequence of the block terminal for a motor may be different from the above sequence.

Then, the block terminal 100 for a motor is disposed between a high voltage connector and a terminal assembly, and is fixed to the high voltage connector and a terminal of the terminal assembly using the fixing nuts 500 insert-mounted into the coupling holes 320 of the busbars 300.

As described above, a block terminal for a motor and a method of manufacturing the same according to some exemplary embodiments has effects in that vibration resistance performance is improved through insert injection molding, the number of components and the number of assembly processes decrease, and a shape of the block terminal is simplified.

In addition, the block terminal for a motor and the method of manufacturing the same according to some exemplary embodiments has effects in that a straight busbar structure is formed so that a volume can be decreased, and a structure is simple so that the block terminal can be shared.

In addition, the block terminal for a motor and the method of manufacturing the same according to some exemplary embodiments has effects in that a coupling structure is changed to an insertion coupling structure from a bolt coupling structure so that the number of components can be decreased and convenience can also be improved.

Although certain exemplary embodiments and implementations have been described herein, other embodiments and modifications will be apparent from this description. Accordingly, the inventive concepts are not limited to such embodiments, but rather to the broader scope of the accompanying claims and various obvious modifications and equivalent arrangements as would be apparent to one of ordinary skill in the art.

What is claimed is:

1. A block terminal for a motor, comprising:

a block base having a horizontal surface, an upper distal surface adjacent a first side of the horizontal surface, and a lower vertical surface extending downward from a second side of the horizontal surface opposite the first side of the horizontal surface;

a busbar disposed in the block base and comprising a first end portion protruding outward from the upper distal surface of the block base in a direction away from the horizontal surface of the block base and a second end portion protruding vertically outward from a distal end of the lower vertical surface of the block base in a direction away from the horizontal surface of the block base, the first and second end portions comprising respective coupling holes;

bushings mounted on sides of the block base; and fixing nuts insert-mounted in the coupling holes of the busbar.

2. The block terminal of claim 1, wherein the block base has an upper vertical surface extending upward from the first side of the horizontal surface of the block base in a vertical direction to the upper distal surface.

3. The block terminal of claim 1, wherein the block base, the busbar, and the bushings are integrally formed through insert injection molding.

4. The block terminal of claim 1, wherein a rear surface of the lower vertical surface of the block base comprises insertion coupling grooves spaced apart from one another.

5. The block terminal of claim 1, wherein a base coupling protrusion protrudes outwardly from a rear surface of the lower vertical surface of the block base.

6. The block terminal of claim 1, wherein the bushings are mounted on opposing third and fourth sides of the horizontal surface of the block base.

7. The block terminal of claim 1, wherein the block base and the busbar comprise bent portions between the horizontal surface and the lower vertical surface.

8. The block terminal of claim 7, wherein a strength reinforcement piece is formed on a bent portion of the block base among the bent portions.

9. The block terminal of claim 1, wherein:

the busbar is one of a plurality of busbars disposed in the block base; and the plurality of busbars are spaced apart from one another in the block base.

10. The block terminal of claim 9, wherein:

the bushings longitudinally extend in a first direction;

the coupling holes of the first end portions longitudinally extend in a second direction; and the coupling holes of the second end portions longitudinally extend in a third direction.

11. The block terminal of claim 10, wherein the first and second directions are substantially parallel with one another.

12. The block terminal of claim 11, wherein the first and third directions are different from one another.

13. The block terminal of claim 12, wherein the first and third directions are substantially perpendicular to one another.

14. The block terminal of claim 10, wherein the first and second directions are different from one another.

15. The block terminal of claim 14, wherein the second and third directions are substantially parallel with one another.

16. The block terminal of claim 15, wherein the first and second directions are substantially perpendicular to one another.

17. A method of manufacturing a block terminal for a motor, the method comprising:

forming, via insert injection molding, a block base comprising a busbar and bushings, the block base having a horizontal surface, an upper distal surface adjacent a first side of the horizontal surface, and a lower vertical surface extending downward from a second side of the horizontal surface opposite the first side of the horizontal surface, the busbar having a first end portion protruding outward from the upper distal surface of the block base in a direction away from the horizontal surface of the block base and a second end portion protruding vertically outward from a distal end of the lower vertical surface of the block base in a direction away from the horizontal surface of the block base, the first and second end portions comprising respective coupling holes, and the bushings being disposed on sides of the block base; and forming the block terminal by press-fitting a coupling nut into the coupling holes of the busbar.

18. The method of claim 17, wherein:

the busbar is one of a plurality of busbars disposed in the block base; and the plurality of busbars are spaced apart from one another in the block base.

19. The method of claim 17, wherein the bushings are disposed on opposing third and fourth sides of the horizontal surface of the block base.

* * * * *